US006427979B1

(12) United States Patent
Vogt

(10) Patent No.: US 6,427,979 B1
(45) Date of Patent: Aug. 6, 2002

(54) REMOVABLE ADAPTER FOR FACILITATING VEHICLE LIFTING WITH A HYDRAULIC FLOOR JACK

(76) Inventor: Glenn Vogt, 14319 State Rte. Y, Rolla, MO (US) 65401

( * ) Notice: Subject to any disclaimer, the term of this patent is extended or adjusted under 35 U.S.C. 154(b) by 0 days.

(21) Appl. No.: 09/596,386

(22) Filed: Jun. 16, 2000

(51) Int. Cl.[7] ..... B66F 3/00
(52) U.S. Cl. ..... 254/133 R
(58) Field of Search ..... 254/133, 134, 254/DIG. 16; 269/17, 296

(56) References Cited

U.S. PATENT DOCUMENTS 2,748,459 A * 6/1956 Orr ..... 254/134
2,749,089 A * 6/1956 Feay et al. ..... 254/134
2,903,258 A * 9/1959 Jovanovich ..... 254/134
4,549,722 A 10/1985 Gagliano
4,607,823 A * 8/1986 Thomas ..... 254/134
4,964,617 A 10/1990 Lawrence
5,372,353 A 12/1994 West
6,000,681 A 12/1999 Hussaini

* cited by examiner

*Primary Examiner*—Robert C. Watson
(74) *Attorney, Agent, or Firm*—Polster, Lieder, Woodruff & Lucchesi

(57) ABSTRACT

An adapter for use with a hydraulic floor jack, the adapter configured mount on a hydraulically actuated lift arm of the hydraulic floor jack and to permit the hydraulic floor jack to be utilized for raising one end of an automotive vehicle body by cradling both the underside of an off-center differential housing, as it typically found on four wheel drive automotive vehicles, and a portion of an unequal length axle on an opposite side of the vehicle lateral center of gravity.

7 Claims, 3 Drawing Sheets

REMOVABLE ADAPTER FOR FACILITATING VEHICLE LIFTING WITH A HYDRAULIC FLOOR JACK

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

The present invention relates to an adapter for use with a hydraulic floor jack, and more particularly, to a removable adapter configured to permit a hydraulic floor jack to be utilized for raising an automotive vehicle body by cradling both the underside of an off-center differential housing and associated unequal length axle, as it typically found on four wheel drive automotive vehicles.

Lifting of automotive vehicles from a solid floor surface utilizing a mobile hydraulic floor jack is a common practice in garages, automotive service stations, or on a road side to facilitate vehicle inspection, tire removal, or vehicle repair. Typically, lift points are located on the underside of a vehicle body adjacent each side of the vehicle, to allow for placement of the hydraulic floor jack, thereby allowing one side of a vehicle to be lifted. Alternatively, either the front or the rear of the vehicle may be lifted by positioning the hydraulic floor jack under a contact point located along the vehicle centerline. One such centerline contact point commonly utilized in lifting an end of a vehicle is the differential housing or ring gear housing, commonly referred to as the "pumpkin". However, on some types of vehicle, such as four-wheel drive vehicles, the differential housing is not located on the vehicle centerline, but rather, is offset to one side to provide clearance for a driveshaft or other vehicle component. Lifting a vehicle from an off-center differential housing can lead to a risk of the vehicle tilting or falling off of the hydraulic floor jack, as the vehicle's center of gravity is not positioned over the hydraulic floor jack. The customary practice to lift an end of a vehicle having an off-center differential housing by first lifting one side of the vehicle, placing a fixed jack stand thereunder, and then lifting the opposite side of the vehicle and placing a second fixed jack stand thereunder. This process of lifting, supporting, lifting and supporting is time consuming and tedious, requiring several steps and multiple pieces of equipment, as well as risking accidental displacement of the vehicle if it shifts off of the first fixed jack stand while being lifted from the opposite side for placement of the second fixed jack stand. Accordingly, it is desirable to provide an adapter suitable for use with a standard commercially available mobile hydraulic floor jack, to facilitate lifting of an end of a motor vehicle having an off-center differential housing from a central lifting point, thereby eliminating the need to provide a pair of fixed vehicle supports.

BRIEF SUMMARY OF THE INVENTION

Among the several objects and advantages of the present invention are:

The provision of an adapter for use with a mobile hydraulic floor jack to facilitate centerline lifting of an automotive vehicle having an off-center differential housing;

The provision of the aforementioned adapter wherein the adapter is removable from the mobile hydraulic floor jack;

The provision of the aforementioned adapter wherein the adapter is configured to cradle a portion of an off-center differential housing and a portion of an unequal length axle;

Briefly stated, the present invention is directed towards a removable adapter for use with a mobile hydraulic floor jack commonly found in a garages or automotive repair shops, to facilitate the balanced lifting of an end of an automotive vehicle having an off-center differential housing. The removable adapter comprises a base configured to seat on the saddle of the mobile hydraulic floor jack, a transverse support member secured at the midpoint to the base, and a pair of contact portions at opposite ends of the transverse support member. The first contact portion is configured to cradle a portion of an off-center vehicle differential housing, and the second contact portion is configured to receive a portion of a vehicle axle shaft extending from the vehicle differential housing, on the opposite side of the vehicle centerline.

During use, the removable adapter of the present invention is placed on the saddle of the hydraulic floor jack, which in turn, is positioned adjacent the underside of the automotive vehicle to be lifted. The precise orientation of the hydraulic floor jack is not critical, provided that the first contact portion of the removable adapter is located beneath the off-center differential housing of the vehicle, and the second contact portion of the removable adapter is located adjacent a portion of the vehicle axle extending from the differential housing, on the opposite side of the vehicle's lateral center of gravity. Actuation of the hydraulic floor jack by conventional means, such as a lever arm lifts the removable adapter into engagement with the differential housing and simultaneously, with the vehicle axle. Continued actuation of the hydraulic floor jack results in a balanced lifting of the automotive vehicle from the two contact points, which are equally spaced on opposite sides of the vehicle centerline.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
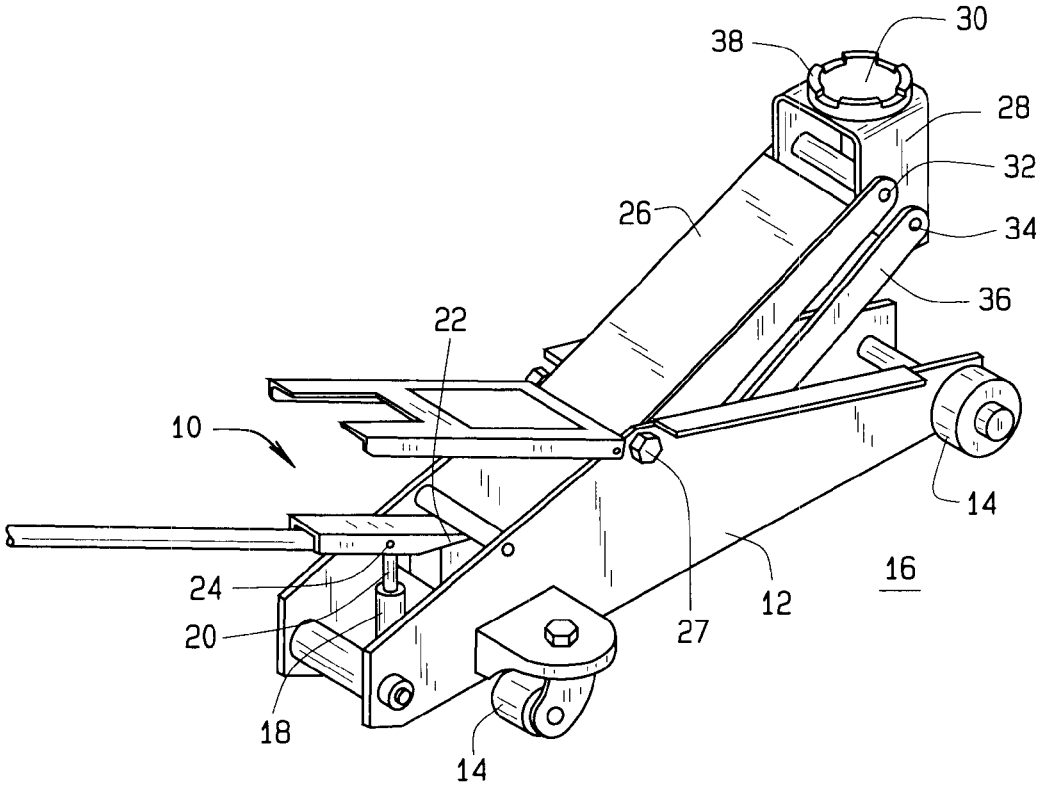
FIG. 1 PRIOR ART
FIG. 1 is a perspective illustration of a prior art mobile hydraulic floor jack.

Referring now to the drawings for a better understanding of this invention, a conventional hydraulic floor jack having a capacity of several thousand pounds is shown in FIG. 1 and indicated generally at 10. Hydraulic floor jack 10 has a body 12 supported by wheels 14 for movement along a floor or other supporting surface 16. A hydraulic fluid reservoir supplies fluid to a pump cylinder shown at 18 having a piston rod 20 extending therefrom. A handle 21 is mounted for pivotal movement above a fixed axis 22 and is pivotally connected at 24 to piston rod 20 for pump cylinder 18. Manual gripping of handle 21 and movement in an up and down direction pumps hydraulic fluid to a lift cylinder connected to a lifting arm 26 pivotally connected at 27 to body 12. Hydraulic fluid pumped to the lift cylinder by pivotal movement of handle 21 effects the raising of lifting arm 26. Lifting arm 26 has a channel-shaped mounting bracket 28 on its extending end for supporting a saddle 30 thereon. Mounting bracket 28 is held in a vertical relation by pivot 32 on lifting arm 26 and by pivot 34 on parallel radius arms or links 36. Hydraulic floor jack 10 and saddle 30 are positioned for saddle 30 to contact the underside of an automotive vehicle body at a suitable lift point for lifting the vehicle thereat. Normally the lift points are located on the frame of the vehicle body adjacent the wheels thereof. Optionally, saddle 30 may be provided with a number of raised protrusions or gripping surfaces 38 to facilitate holding of the vehicle lift points during operation of the hydraulic floor jack 10.

Figure 2:
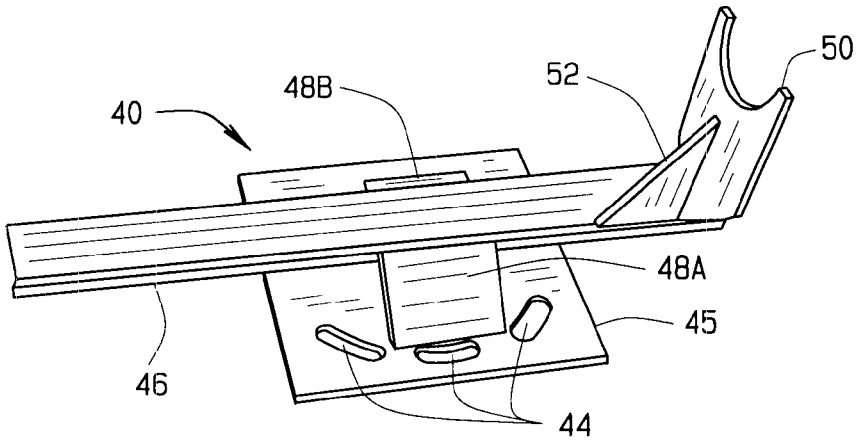
FIG. 2 is a perspective illustration of one embodiment of the removable adapter of the present invention.
Figure 3:
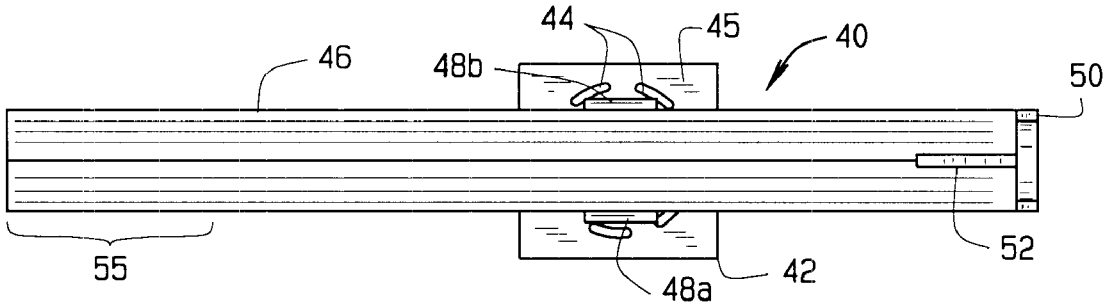
FIG. 3 is a top plan view of the removable adapter illustrated in FIG. 2.
Figure 4:
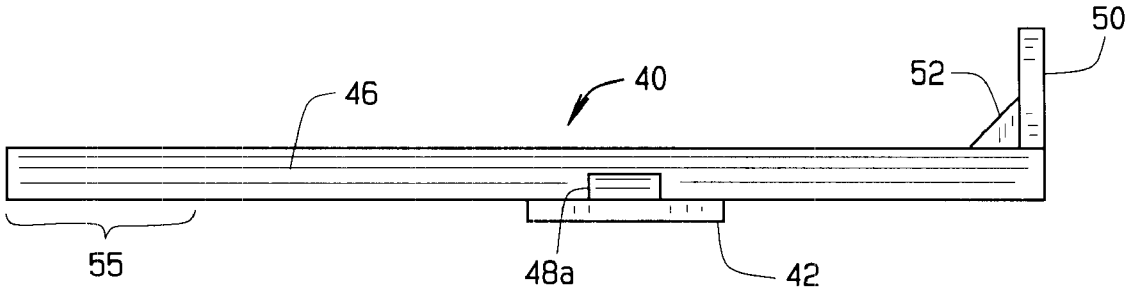
FIG. 4 is a side plan view of the removable adapter illustrated in FIG. 2.

Turning to FIGS. 2 through 4, the removable adapter of the present invention is illustrated generally at 40. The adapter 40 preferably comprises a horizontal base plate 42 configured to seat on the saddle 30 of the hydraulic floor jack 10. The base plate 42 has a vertical center axis, and may be of a variety of configurations depending upon the configuration of the saddle 30. As illustrated in FIG. 2, the base plate 42 is square, with a number of receiving slots 44 positioned about the vertical center axis to engage the raised protrusions or gripping surfaces 38 of the saddle 30, thereby preventing movement and rotation relative thereto. Those of ordinary skill in the art will readily recognize that alternative configurations for base plate 42 may be utilized with in the scope of this invention, for example, the base plate 42 may be of a circular configuration, or may not include any receiving slots 44. Alternatively, the saddle 30 may be removed from the hydraulic floor jack 10, and the base plate 42 configured with an axial pin (not shown) on the underside, configured to seat in the bore (not shown) from which the saddle 30 was removed.

Transverse support arm 46 is secured to an upper surface 45 of the base plate 42 such that portions 42A and 42B of the support arm 46 extend from opposite sides of the base plate 42. The support arm 46 is secured to the upper surface 45 such that it passes over the center of the base plate 42, bisecting the upper surface, and extends beyond the periphery of the base plate 42 on opposite sides. In the embodiment illustrated in FIGS. 2–4, the support arm 46 is constructed from a length of high-strength steel formed in a 90° "V" configuration, and is secured to the base pate 42 by two short support braces 48A, 48B, formed from the same material, positioned on either side of the support arm 46 in an inverted 90° "V" configuration to form a seat for the support arm 42. Those of ordinary skill in the art will readily recognize that a variety of materials may be utilized to form the support arm 46, including, but not limited to, solid steel bars, tubular steel, and channel steel. Alternatively, two separate support arms secured to, and extending radially in diametrically opposite directions from the vertical center axis of the base plate 42 may be employed. In the preferred embodiment, the total length of the transverse support arm 46 is approximately 18 inches, and the support arm 46 is secured to the base plate 42 approximately 11 inches from one end, such that each portion extending from opposite sides of the base plate 42 are of unequal length.

An axle receiving flange 50 is secured to the support arm 46 at the end of the shorter length 42A, and is configured to receive therein the cylindrical portion of an automotive vehicle axle associated with the differential housing. A suitable support member 52 provides rigidity to the axle receiving flange 50, thereby preventing twisting or movement relative to the support arm 46. In the preferred embodiment, the axle receiving flange 50 extends approximately 5 inches above the portion 42A of support arm 42, and is configured to receive any cylindrical axle having a diameter of approximately 4 inches or less. Such dimensions have been found to be suitable for the majority of automotive vehicles serviced in automotive repair shops. Those of ordinary skill in the art will readily recognize that the vertical displacement of the axle receiving flange 50 above the support arm 42 corresponds proportionally to the distance between the lowest portion of the automotive axle and the lowest portion of the differential housing, as measured at a vertical axis thereof. Furthermore, it will be readily recognized that the axle receiving flange may be configured to be vertically adjustable, allowing for the vertical displacement to be adjusted to correspond to variations in axle diameter and differential housing diameters between automotive vehicles.

As can be seen in FIGS. 2–4, the end of portion 42B of support arm 46, opposite the axle receiving flange 50, forms a differential housing receiver 55, and is preferably is left open, as the 90° "V" configuration of the preferred embodiment is suitably sized to cradle a lower portion of the majority of automotive vehicle differential housings. The specific length of portion 42B of support arm 46 is selected so as to extend beyond the vertical axis, or lowest point, of the majority of off-center differential housings found in automotive vehicles as measured from the vehicle's lateral center of gravity. Extending the length of portion 42B beyond the lowest point of the off-center differential housings provides a degree of safety in the event the vehicle shifts laterally during lifting, preventing the off-center differential housing from sliding out of the differential housing receiver 55. Correspondingly, the specific length of portion 42A of support arm 46 is selected so as to be substantially equivalent, i.e., within an accepted tolerance, of the displacement of the vertical axis, or lowest point, of the majority of off-center differential housings found in automotive vehicles as measured from the vehicle's lateral center of gravity, thereby facilitating lifting of the automotive vehicle from two points on equal and opposite sides of the vehicle's lateral center of gravity. In an alternative embodiment, both portions 42A and 42B of the transverse support arm 42 may be configured to be adjustable in length, thereby accommodating a wider variety of automotive vehicles.

Those of ordinary skill in the art will recognize that the differential housing support end of the support arm 46 may be configured with a variety of seats or cradles configured to receive or fit portions of off-center differential housings of differing sizes. Correspondingly, the axle receiving flange 50 may be modified to have any of a variety of configurations suited for receiving the cylindrical portion of an automotive vehicle axle therein, including a variable configuration.

Figure 5:
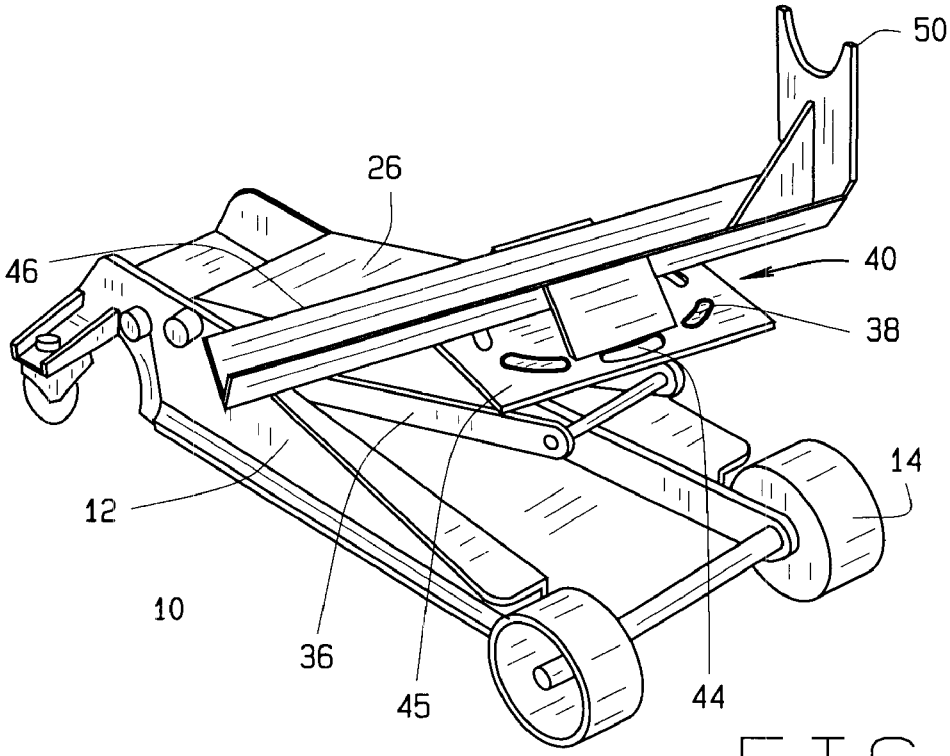
FIG. 5 is a perspective view of the removable adapter illustrated in FIG. 2 seated on the prior art mobile hydraulic floor jack of FIG. 1.
Figure 6:
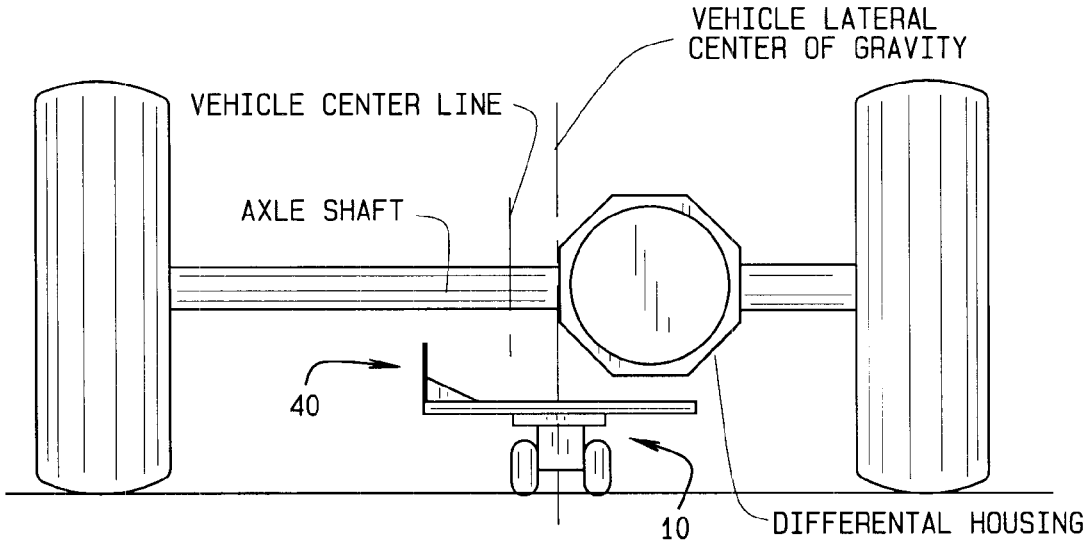
FIG. 6 is an end view of the adapter/jack combination of FIG. 5 positioned below an automotive vehicle.
Figure 7:
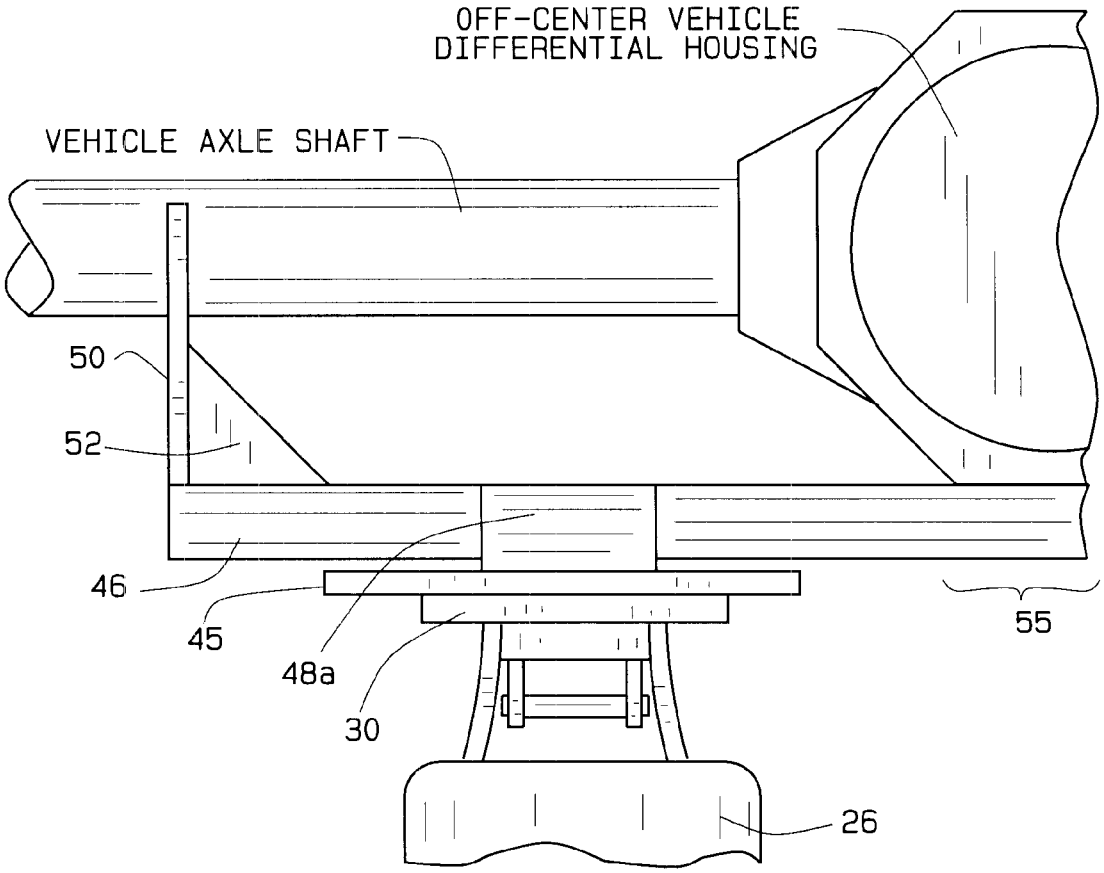
FIG. 7 is an end view of the adapter/jack combination of FIG. 5 in engagement with an off-center differential housing and vehicle axle member for lifting of the automotive vehicle.

FIGS. 5–7 illustrate a method of use of the removable adapter 40 of the present invention. With the hydraulic floor jack 10 in a lowered position, the removable adapter 40 is placed on the saddle 30, such that the receiving slots 44 in the base plate 42 engage the raised protrusions or gripping surfaces 38 of the saddle 30. Typically, saddle 30 is configured to permit rotation about a vertical axis VA, and as such, the exact orientation of the removable adapter 40 relative to the hydraulic floor jack longitudinal centerline does not matter, as the orientation may be adjusted as required for proper position underneath the automotive vehicle being lifted by rotation of the saddle 30. Once seated on the saddle 30, the removable adapter 40 is positioned beneath the vehicle to be lifted, such that the vertical axis VA of the saddle intersects the vehicle's lateral center of gravity, typically corresponding to the vehicle centerline CL, and the transverse support arm 46 of the removable adapter 40 is parallel to an axle of the vehicle associated with the off-center differential housing. Actuating the hydraulic floorjack 10 elevates the saddle 30, and correspondingly the removable adapter 40. Continued actuation results in the axle receiving flange 50 contacting the associated axle of the vehicle on a first side of the vehicle center of gravity, while the opposite end of the support arm 46 cradles the underside of the differential housing in the housing receiver 55 on the opposite side of the vehicle center of gravity. Further actuation of the hydraulic floor jack 10 results in a lifting force being transferred through the saddle 30, and to the automotive vehicle at the two contact points, defined by the contact point of the axle receiving flange 50, and the housing receiver 55, on opposite sides of the vehicle lateral center of gravity, thereby vertically elevating the vehicle body while maintaining a balanced lifting force on both sides of the vehicle center of gravity. It will be readily appreciated that to achieve a balanced lifting of the vehicle, the two contact points must be equally displaced, to within a specified tolerance, on opposite sides of the vehicle's lateral center of gravity. Upon lifting of the vehicle a small distance from the ground, it will be readily apparent to one of ordinary skill in the art if the two contact points are not equally displaced on opposite sides of the vehicle's lateral center of gravity, as one side of the vehicle will lift from the ground before the opposite side. To correct a misplacement of the contact points, the hydraulic floor jack 10 is lowered, and shifted laterally towards the side of the vehicle which lifted from the ground last, after which the lifting process is repeated.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

I claim:

1. An adapter for lifting of an automotive vehicle having a lateral center of gravity, an off-center differential housing displaced laterally from said lateral center of gravity, and associated axle shaft, with a hydraulic floor jack having hydraulically actuated lifting arm for raising the vehicle body upon movement of the lifting arm in an upward direction, comprising:

a horizontal base plate having an upper and lower surface, said base plate configured to removably seat on said lifting arm;

a transverse support arm secured to said upper surface of said horizontal base plate, said transverse support arm positioned to bisect said upper surface, and having a first portion extending laterally from a center of said base plate and a second portion extending laterally from said center of said base plate opposite said first portion;

said first portion of said transverse support arm configured to cradle a lower portion of said off-center differential housing laterally from said center of said base plate; and said second portion of said transverse support arm configured to receive a portion of said associated axle shaft laterally from said center of said base plate opposite said first portion and on an opposite side of said vehicle's lateral center of gravity from said off-center differential housing.

2. The adapter of claim 1 wherein an outer end of said second portion of said transverse support arm is vertically displaced relative to said first portion of said transverse support arm, said vertical displacement proportional to a distance between an outer diameter of said associated axle and an outer diameter of said differential housing.

3. The adapter of claim 1 wherein said lateral extension of said first portion of said transverse support arm is at least substantially equivalent to displacement from said lateral center of gravity of said vehicle to a vertical axis of said off-center differential housing.

4. The adapter of claim 1 wherein said lateral extension of said second portion of said transverse support arm is substantially equivalent to displacement from said lateral center of gravity of said vehicle to a vertical axis of said off-center differential housing.

5. The adapter of claim 2 wherein said out end of said second portion of said transverse support arm includes an axle shaft receiving bracket secured perpendicular thereto, said axle shaft receiving bracket extending vertically upward therefrom and having an upper surface configured to seat an outer surface of a vehicle axle.

6. The adapter of claim 1 wherein said hydraulic floor jack includes a saddle on said hydraulically actuated lift arm, said base plate configured to removably seat on said saddle.

7. An adapter for facilitating lifting of an automotive vehicle with a hydraulic floor jack, said automotive vehicle having a lateral center of gravity, an off-center differential housing displaced laterally from said lateral center of gravity, and an associated axle shaft, said hydraulic floor jack having a hydraulically actuated lifting arm for raising said automotive vehicle above a surface upon movement of said lifting arm in an upward direction, comprising:

a horizontal base plate configured to engage an upper surface of said hydraulically actuated lifting arm;

a first support arm secured to said base plate, said first support arm radially extending outward from said base plate;

a differential housing receiver located on said first support arm and spaced radially away from said horizontal base plate, said differential housing receiver configured to cradle a lower portion of said off-center differential housing;

a second support arm secured to said base plate, said second support arm radially extending outward from said base plate diametrically opposite said first support arm;

an axle shaft receiver secured to an end of said second support arm opposite said base plate, said axle shaft receiver extending vertically upward from said end of said second support arm and configured to cradle a lower portion of said associated axle shaft; and wherein said axle shaft receiver and said differential housing receiver are equally spaced from a center axis of said base plate such that said axle shaft receiver and said differential housing receiver are configured to engage said automotive vehicle at points substantially equally displaced on either side of said lateral center of gravity of said automotive vehicle.

* * * * *